United States Patent [19]

Kovacik et al.

[11] Patent Number: 4,726,538

[45] Date of Patent: Feb. 23, 1988

[54] PULLEY FOR EXTENSION CORD REEL

[75] Inventors: James D. Kovacik; James W. Kovacik, both of Parma; Thomas J. Blanch, Hudson; Paul S. Blanch, Valley View, all of Ohio

[73] Assignee: Alert Stamping & Mfg. Co., Inc., Bedford Heights, Ohio

[21] Appl. No.: 895,232

[22] Filed: Aug. 11, 1986

[51] Int. Cl.[4] ..... B65H 75/48; B65H 75/14; B65H 75/22

[52] U.S. Cl. ..... 242/107; 242/71.8; 242/107.5; 242/116; 242/118.6

[58] Field of Search ..... 242/107, 115, 107.2, 242/116, 107.3, 118.6, 118.61, 118.62, 71.8, 107.5; 254/375, 376, 266; 474/152, 166

[56] References Cited

U.S. PATENT DOCUMENTS

| | | | |
|---|---|---|---|
| 2,323,275 | 6/1943 | Lofgren | 242/107 X |
| 3,041,005 | 6/1962 | Wallace | 242/116 |
| 3,743,209 | 7/1973 | Anderson | 242/115 X |
| 3,846,887 | 11/1974 | Woods et al. | 242/115 X |
| 3,876,073 | 4/1975 | Herbetko | 242/115 X |
| 4,128,215 | 12/1978 | Underwood | 242/115 X |
| 4,534,520 | 8/1985 | Yanagihara | 242/107 |
| 4,542,858 | 9/1985 | Manges | 242/107 X |

*Primary Examiner*—John Petrakes

*Attorney, Agent, or Firm*—Marshall & Melhorn

[57] ABSTRACT

A pulley for use in storing an electrical extension cord includes a pulley body having a generally tubular cord winding body with a radially outwardly extending flange formed at one end of its exterior surface. A generally disk-shaped flange plate is releasably attached to the other end of the winding body by locking tabs formed on the winding body which cooperate with apertures formed in the flange plate. Typically, the pulley body is formed of a nylon material and the flange plate is formed of steel. The winding body includes an internal wall and an aperture is formed in the wall and another aperture is formed in the flange plate for rotatably mounting the pulley on a supporting shaft. A coil spring has one end attached to the shaft and the other end attached to the winding body for automatically rewinding the extension cord.

16 Claims, 7 Drawing Figures

PULLEY FOR EXTENSION CORD REEL

BACKGROUND OF THE INVENTION

The present invention relates generally to a pulley for use in storing an extension cord in a reel and, in particular, to a two piece pulley including a rewind spring.

Prior art electrical extension cord reel assemblies are typically formed with an outer metallic case enclosing a cord winding reel and ratchet mechanism. The cord winding wheel is generally formed of several stamped metal parts including a pair of disk-shaped flanges and a generally tubular winding body. The flanges are attached at opposite ends of the winding body to form a cord winding area for storing an extension cord. Such a construction is costly in terms of manufacturing and assembling the various parts.

SUMMARY OF THE INVENTION

The present invention concerns a pulley or reel for use in storing an electrical extension cord in an extension cord reel assembly. The pulley includes a pulley body having a generally tubular winding body formed with a radially outwardly extending flange near one end thereof. A generally disk-shaped flange plate is releasably attached to the other end of the winding body by generally axially extending locking tabs formed on the winding body which releasably engage apertures formed in the flange plate. The winding body can also have locating tabs formed thereon for engaging other apertures in the flange plate which locating tabs and apertures are positioned so as to define a predetermined radial relationship between the winding body and the flange plate.

The winding body and flange plate are rotatably mounted on a supporting shaft and a coil spring is connected between the supporting shaft and the winding body for automatically rewinding the cord. The winding body and flange can be formed integrally from a nylon material which tends to insulate the electrical connections between the extension cord and a cord leading from an outer case to be plugged into a power source. Also, a pawl is rotatably mounted on an outside surface of the flange plate for cooperation with a detent mechanism. Retaining slots are provided in the flange plate and the winding body for a ground strip utilized to ground the metal flange plate to a ground wire of the extension cord.

It is an object of the present invention to provide an extension cord reel which is less costly to manufacture and assemble than prior art cord reels.

It is another object of the present invention to provide a pulley for an extension cord reel assembly which can be easily disassembled for repair.

BRIEF DESCRIPTION OF THE DRAWINGS

The above as well as other objects of the invention may become apparent to one skilled in the art from reading the following detailed description of a preferred embodiment of the invention when considered in the light of the attached drawings in which.

DESCRIPTION OF THE PREFERRED EMBODIMENT

Figure 1:
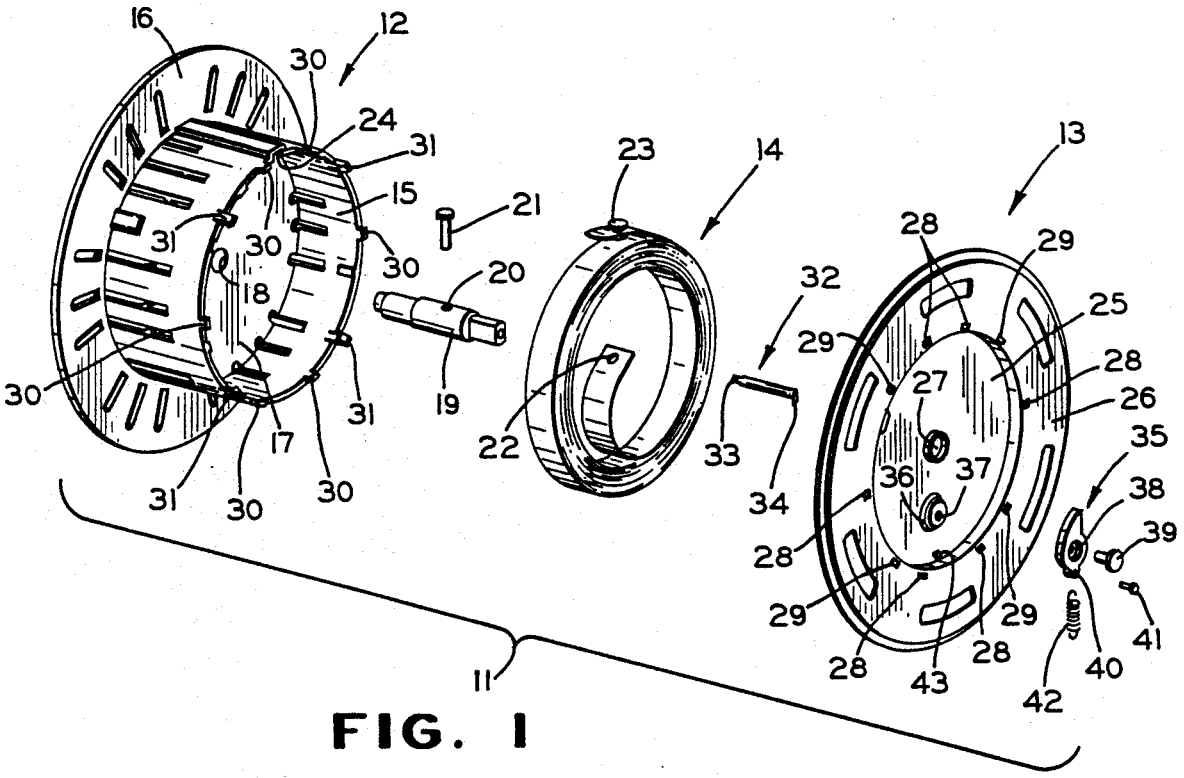
FIG. 1 is an exploded perspective view of a pulley for an extension cord reel according to the present invention.

FIG. 1 is an exploded perspective view of a pulley or reel 11 for use in an extension cord reel assembly. The pulley 11 includes a pulley body 12 which cooperates with a flange plate 13 to enclose and retain a return spring 14. The pulley body 12 has a generally tubular cord winding body 15 having a radially outwardly extending flange 16 formed at one end thereof. A radially extending internal wall 17 is located intermediate the ends of the body 15 and has a centrally located aperture 18 formed therein. The central aperture 18 accepts one end of a supporting shaft 19. The shaft 19 has a centrally located radially extending aperture 20 formed therein for receiving a pin or rivet 21.

The spring 14 is of the coil type formed of a continuous length of flat steel spring stock. At an inner end of the coil, an aperture 22 is formed through which the pin 21 extends before entering the aperture 20 in the shaft 19. Thus, the pin 21 attaches the inner end of the return spring 14 to the shaft for rotation therewith. The spring 14 and shaft 19 assembly is inserted into the interior of the cord winding body 15 through the open end opposite the flange 16. This open end is then closed by the flange plate 13. The outer end of the spring 14 has a pin or rivet 23 attached thereto. The head of the pin 23 is received in a slot 24 formed in the interior of the wall of the body 15 and extending generally parallel to the longitudinal axis of the body 15 and the longitudinal axis of the shaft 19. The slot 24 retains the outer end of the spring 14 stationery with respect to the pulley body 12 as the shaft 19 is being rotated, as will be described below.

Figure 2:
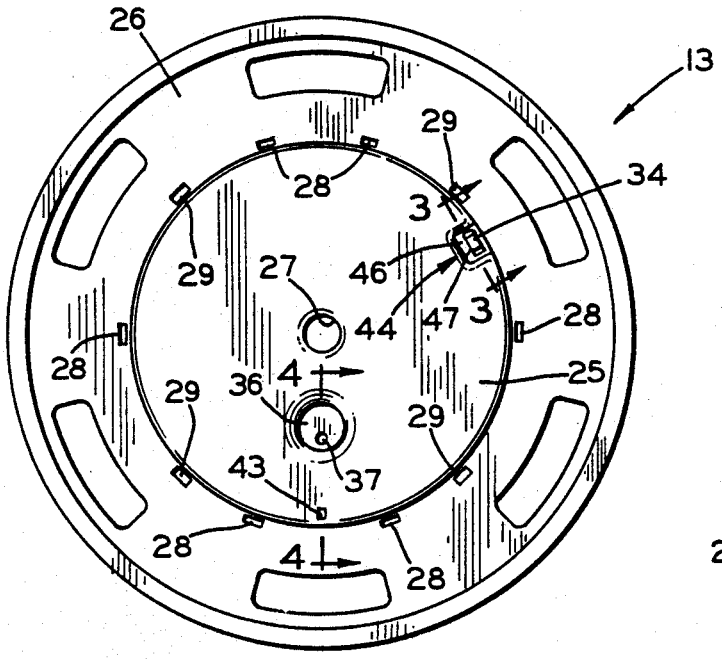
FIG. 2 is a front elevational view of a flange plate included in the pulley shown in FIG. 1.

The flange plate 13 is generally disk-shaped with a central cup-shaped portion 25. The cup-shaped portion 25 is dimensioned to fit inside the wall of the cord winding body 15 such that the outer edge of the end of the body 15 abuts the inwardly facing surface of an outer rim portion 26 of the flange plate 13. A central aperture 27 is formed in the central portion 25 to receive an opposite end of the supporting shaft 19. As shown in FIGS. 1 and 2, the flange plate 13 has a plurality of smaller openings 28 and larger openings 29 formed in the rim portion 26 adjacent the transition to the cup-shaped portion 25.

The pulley body 12 has a plurality of shorter locating tabs 30 extending axially from the edge of the cord winding body 15 facing the flange plate 13. The tabs 30 cooperate with the smaller openings 28 in the flange plate 13 to locate the flange plate in a radial position with respect to the pulley body 12. The pulley body 12 also includes a plurality of longer locking tabs 31 which cooperate with the larger openings 29 in the flange plate 13 to releasably retain the pulley body 12 and the flange plate 13 together. The flange 16, the rim 26 and the body 15 cooperate to define an extension cord storage area. Typically, the pulley body 12 is formed of a nylon material and the flange plate 13 is formed of a metal such as steel.

The pulley assembly 11 includes a ground strip 32 having one end 33 adapted to accept a terminal (not shown) attached to a ground wire of a cord to be wound on the reel. An opposite end 34 is bent at right angles to the body of the ground strip 32. The ground strip 32 extends in a generally axial direction along the inner surface of wall of the cord winding body 15 with the terminal end 33 extending through an aperture in the wall 17 as will be discussed below and the other end 34 retained in a pocket as will be discussed in connection with FIGS. 2 and 3. The ground strip 32 is formed of an electrically conducting material and is utilized to connect the ground wire of an extension cord to the electrically conducting body parts of the pulley 11 such as the flange 13.

A pawl 35 is rotatably mounted on a boss 36 formed on the central portion 25 of the flange plate 13. The boss 36 extends in an axial direction from the outwardly facing surface of the central portion 25 and includes an aperture 37 formed therein. The pawl 35 has a stepped aperture 38 formed therein for receiving the head of a pin or rivet 39. The body of the pin or rivet 39 extends through the aperture 37 and the boss 36 and is flattened to pivotally retain the pawl 35 on the boss 36. The pawl 35 also has a smaller aperture 40 formed therein for receiving a pin or rivet 41 which then extends through one looped end of a tension spring 42. The opposite end of the spring 42 is retained by a tab 43 formed near the outer periphery of the central portion 25.

Figure 3:
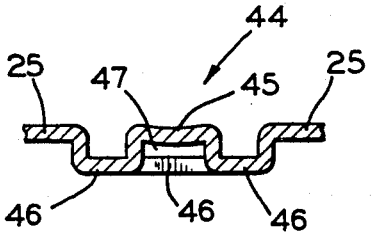
FIG. 3 is an enlarged, fragmentary cross-sectional view taken along the line 3—3 in FIG. 2.

Referring to FIGS. 2 and 3, the other end 34 of the ground strip 32 is inserted into a retaining slot 44 which exposes a portion of the end 34 on the outer surface of the central portion 25 of the flange plate 13. The retaining slot 44 is formed at the periphery of the central portion 25. A generally square section 45 of the portion 25 is outlined by deforming the wall axially outwardly toward the rim portion 26 to form an enclosing wall 46. A pair of slots 47 spaced apart along a radial line from the center of the aperture 27 through the retaining slot 44 permits the insertion of the end 34 of the ground strip 32.

Figure 4:
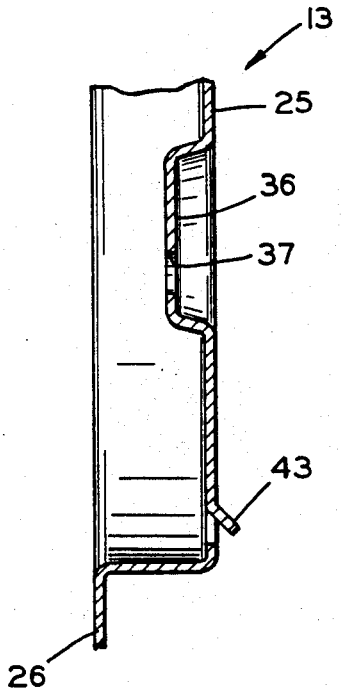
FIG. 4 is an enlarged, fragmentary cross-sectional view taken along the line 4—4 in FIG. 2.

There is shown in FIG. 4, in greater detail, the boss 36 and the tab 43. The boss 36 is formed by extending a generally circular portion of the central portion 25 in an axial direction toward the outwardly facing surface of the flange plate 13. The center of the boss 36 is formed with a planar surface generally parallel to the surface of the central portion 25. Also shown is the aperture 37 for receiving the body of the pin or rivet 39. The aperture is of a sufficient diameter to accept a smaller diameter end of the pin or rivet 39 which has a stepped shank with a portion of the shank closer to the head having a larger diameter than the other end of the shank. Thus, the step provides a stop for the pin 39 as it is inserted in the aperture 37 thereby rotatably retaining the pawl 35 on the larger diameter portion of the shank between the boss 36 and the head of the pin 39. The tab 43 is formed by cutting a generally U-shaped slot in the central portion 25 and bending the central portion thereof toward the inner surface of flange plate 13.

Figure 5:
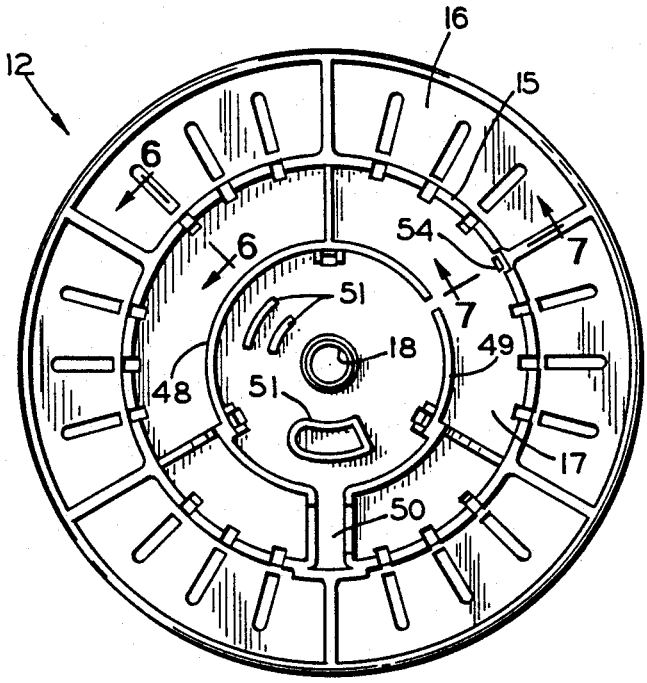
FIG. 5 is an front elevational view of a pulley body included in the pulley shown in FIG. 1.

There is shown in FIG. 5 the outwardly facing surface of the pulley body 12. The cord winding body 15 has the radially outwardly extending flange 16 formed adjacent an outer edge thereof. The wall 17 is spaced inwardly from the flange 16 (see FIG. 7). A pair of walls 48 and 49 extend in almost a complete circle about the central aperture 18. The walls 48 and 49 also extend radially to join the cord winding body 15 and form a channel 50 for directing an extension cord (not shown) to the interior space defined by the walls. The extension cord typically is a three wire assembly. The wires (not shown) are positioned in a predetermined fashion by a plurality of upstanding walls 51 extending from the surface of the wall 17. The ends of the extension cord are adapted to be connected in a known fashion to a power cord attached to an outer case (not shown) for enclosing the pulley 11 and including a plug for insertion into a power source receptacle.

Figure 6:
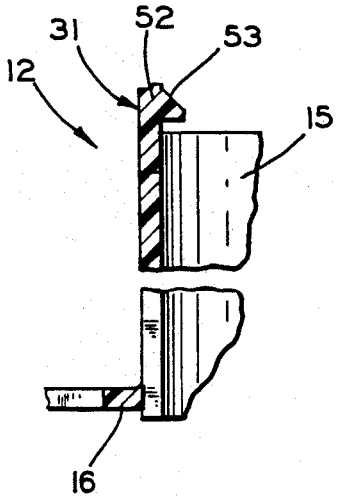
FIG. 6 is an enlarged, fragmentary cross-sectional view taken along the line 6—6 in FIG. 5.

There is shown in FIG. 6 a portion of the cord winding body 15 and the flange 16 showing one of the locking tabs 31. Each of the locking tabs 31 is formed with an enlarged head portion 52 having a ramp surface 53 formed thereon. As the flange plate 13 is moved into locking engagement with the pulley body 12, each of the enlarged heads 52 will have its ramp surface 53 come into contact with the inwardly facing surface of the rim portion 26. The locking tabs 31 will be forced radially outwardly until the enlarged heads 52 snap through the corresponding ones of the larger openings 29 and snap into locking engagement.

Figure 7:
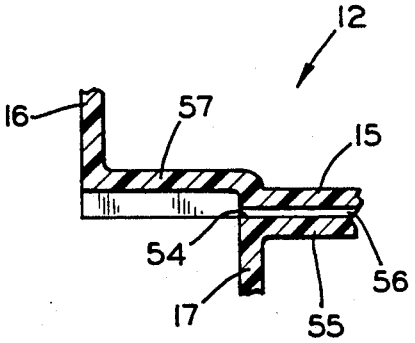
FIG. 7 is an enlarged, fragmentary cross-sectional view taken along the line 7—7 in FIG. 5.

There is shown in FIG. 7 a cross-sectional view of a portion of the pulley body 12 including an aperture 54 formed in the wall 17 for accepting the terminal end 33 of the ground strip 32. At least a portion of the inner surface of the cord winding body 15 on the inwardly facing side of the wall 17 cooperates with the wall 55 to form a passage 56 for the central body of the ground strip 32. On the opposite, or outwardly facing side of the wall 17, the cord winding body 15 is displaced radially outwardly as at 57 to provide an area for receiving a female electrical terminal on the male end 33 of the ground strip 32.

If one or both of the supporting shaft 19 are fixed with respect to, for example, an outer case, the pulley body 12 and flange plate 13 can be rotated together to wind and unwind the spring 14. Thus, rotation in a counterclockwise direction as viewed from the flange plate 13 end of the shaft 19 will tend to wind up or tighten the spring 14. Such rotation is usually accomplished by pulling the extension cord to unwind it from the body 15. When the force unwinding the cord is released, the spring 14 will tend to unwind thereby rotating the pulley in a clockwise direction to wind up the cord on the body 15. The pawl 35 will cooperate with a conventional detent mechanism (not shown) to prevent winding by the spring 14 when the extension cord is extended until the detent is disengaged.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A pulley for use in storing an electrical extension cord comprising:

a pulley body having a generally tubular cord winding body with a radially outwardly extending flange formed on its exterior surface;

a generally disk-shaped flange plate having a generally axially extending boss formed thereon and a tab spaced from said boss and including a pawl and a spring, said pawl being rotatably mounted on said boss and said spring having one end attached to said pawl and an opposite end retained by said tab; and means for releasably attaching said flange plate to one end of said winding body, said flange plate, said outwardly extending flange and said winding body defining a storage area for an electrical extension cord.

2. The pulley according to claim 1 wherein said pulley body is formed of a nylon material.

3. The pulley according to claim 2 wherein said flange plate is formed of steel.

4. The pulley according to claim 1 wherein said winding body is open at opposite ends and has a generally radially extending internal wall formed intermediate said ends.

5. The pulley according to claim 4 wherein said internal wall and said flange plate each have a central aperture formed therein and including a supporting shaft having opposite ends retained in said apertures.

6. The pulley according to claim 1 wherein said pulley body and said flange plate are rotatably mounted on a supporting shaft and including a spring means attached to said shaft and to said pulley body for rotating said pulley body and said flange plate about said supporting shaft.

7. The pulley according to claim 1 wherein said means for releasably attaching includes at least one aperture formed in said flange plate and at least one locking tab formed on said pulley body, said locking tab releasably engaging said aperture when said flange plate abuts said pulley body.

8. The pulley according to claim 7 wherein said locking tab includes an enlarged head portion having a ramp surface formed thereon.

9. An extension cord reel pulley comprising:

a generally tubular winding body;

a radially outwardly extending flange attached to said winding body;

a generally disk-shaped flange plate;

means for releasably attaching said flange plate to said winding body in spaced apart relation to said flange;

a supporting shaft, said winding body and said flange plate being rotatably mounted on said supporting shaft wherein said winding body and said flange are formed as an integral pulley body having a generally radially inwardly extending wall formed in said winding body and an aperture formed in said wall for retaining an end of said supporting shaft; and said wall having another aperture formed therein and said flange plate having a retaining slot formed therein and including a ground strip having a terminal end extending through said another aperture and another end retained in said retaining slot.

10. The pulley according to claim 9 wherein said pulley body is formed of a nylon material.

11. The pulley according to claim 10 wherein said pulley body has a plurality of generally axially extending locking tabs formed thereon and said flange plate has a plurality of apertures formed therein, each of said locking tabs releasably engaging a corresponding one of said plurality of apertures.

12. The pulley according to claim 11 wherein said pulley body has a plurality of generally axially extending locating tabs formed thereon, each of said locating tabs engaging a corresponding one of said plurality of apertures, said locating tabs and said corresponding apertures being positioned to radially orient said flange plate with respect to said pulley body.

13. The pulley according to claim 10 wherein said flange plate is formed of steel and includes an aperture for retaining an opposite end of said supporting shaft.

14. A reel for use in winding a flexible cord comprising:

a generally tubular winding body having a radially outwardly extending flange formed on an outer surface thereof adjacent one end of said winding body;

a generally disk-shaped flange plate having a plurality of apertures formed therein;

said winding body and said flange plate being rotatably mounted on a supporting shaft and including a coil spring having one end attached to said shaft and an opposite end attached to said winding body; and a plurality of locking tabs formed on said winding body at an opposite said flange, each of said locking tabs releasably engaging a corresponding one of said apertures whereby said flange plate is releasably attached to said winding body in spaced apart relation to said flange to define a cord winding area on said outer surface of said winding body.

15. The reel according to claim 14 wherein said winding body includes a plurality of locating tabs formed thereon and extending in a generally axial direction to engage corresponding ones of said plurality of apertures, said locating tabs and said corresponding ones of said plurality of apertures being positioned to define a predetermined radial relationship between said winding body and said flange plate.

16. The reel according to claim 14 wherein said winding body and said flange are formed of a nylon material and said flange plate is formed of steel.

* * * * *